US005662056A

United States Patent [19]

Lin

[11] Patent Number: 5,662,056

[45] Date of Patent: Sep. 2, 1997

[54] MOVABLE CARRIAGE BOARD FOR INDUSTRIAL SEWING MACHINE

[75] Inventor: Yuan-Kuang Lin, Tu-Chen, Taiwan

[73] Assignee: China Textile Institute, Taipei Shien, Taiwan

[21] Appl. No.: 636,410

[22] Filed: Apr. 23, 1996

[51] Int. Cl.[6] ..... D05B 41/00; D05B 75/00; A47B 9/04

[52] U.S. Cl. ..... 112/217.1; 112/260; 108/96

[58] Field of Search ..... 112/217.1, 260, 112/258, 2; 108/92, 94, 95, 96, 97, 98, 108

[56] References Cited

U.S. PATENT DOCUMENTS 1,624,862 4/1927 Elliot ..... 108/96
3,068,821 12/1962 Hermanns ..... 108/98 X
3,726,237 4/1973 Devey et al. ..... 112/217.1 X
4,315,473 2/1982 Torre ..... 112/217.1

*Primary Examiner*—Peter Nerbun
*Attorney, Agent, or Firm*—Morton J. Rosenberg; David I. Klein

[57] ABSTRACT

A movable carriage board for use with an industrial sewing machine is disclosed. The carriage board designed to provide the operator of a sewing machine the space for the arrangement of cut parts comprises a stationary rod attached at two ends respectively to a support frame and a base frame of the sewing machine and an extension rod to which a flat board is secured by means of a fixing mechanism. The stationary rod and the extension rod are combined by a double pipe sleeve that is furnished with a fastening mechanism for changing the position and the elevation of the extension rod. The inventive carriage board is adaptable for laying short cut parts and hanging long cut parts on it, enhancing the working efficiency of the operator.

1 Claim, 2 Drawing Sheets

MOVABLE CARRIAGE BOARD FOR INDUSTRIAL SEWING MACHINE

BACKGROUND OF THE INVENTION

The invention generally relates to a carriage board used with an industrial sewing machine, especially to a carriage board that has a stationary rod attached to the support frame of an industrial sewing machine and an extension rod to which a flat board is secured by means of an adjustable fixing mechanism, with a double pipe sleeve combining these two rods by fastening bolts. The carriage board according to the invention can be changed in its position and elevation in consistence with the processing requirements and an operator's body size, achieving the maximum adaptability.

In the sewing operation of the clothing production in a garment factory, there are assorted cut parts that differ in colors, shapes, sizes, and so on. They have to be placed classifiedly so as to be picked and taken up quickly in a later use. However, in a conventional industrial sewing machine there was no specific arrangement for operators to place cut parts. As a result, operators often put baskets, stands, or the like on the side of the sewing machine to lay or hang these cut parts. This not only takes greater space but also is inconvenient for the operation of the machine and the picking of the cut parts. To improve the deficiency of a conventional industrial sewing machine, the object of the invention is to provide a carriage board that can be affixed to a sewing machine as a table for the placement of cut parts and that has a stationary rod adjustably combined with an extension rod by means of a double pipe sleeve so that the carriage board can change its position and elevation in compliance with the work space to achieve the optimum compatibility and to provide the operator of the sewing machine the convenience of the arrangement and the picking up of cut parts.

The structure, features and advantages of the invention will become apparent by reading the following detailed description of a preferred embodiment and by reference to the accompanying drawings in which.

DETAILED DESCRIPTION OF THE INVENTION

Figure 1:
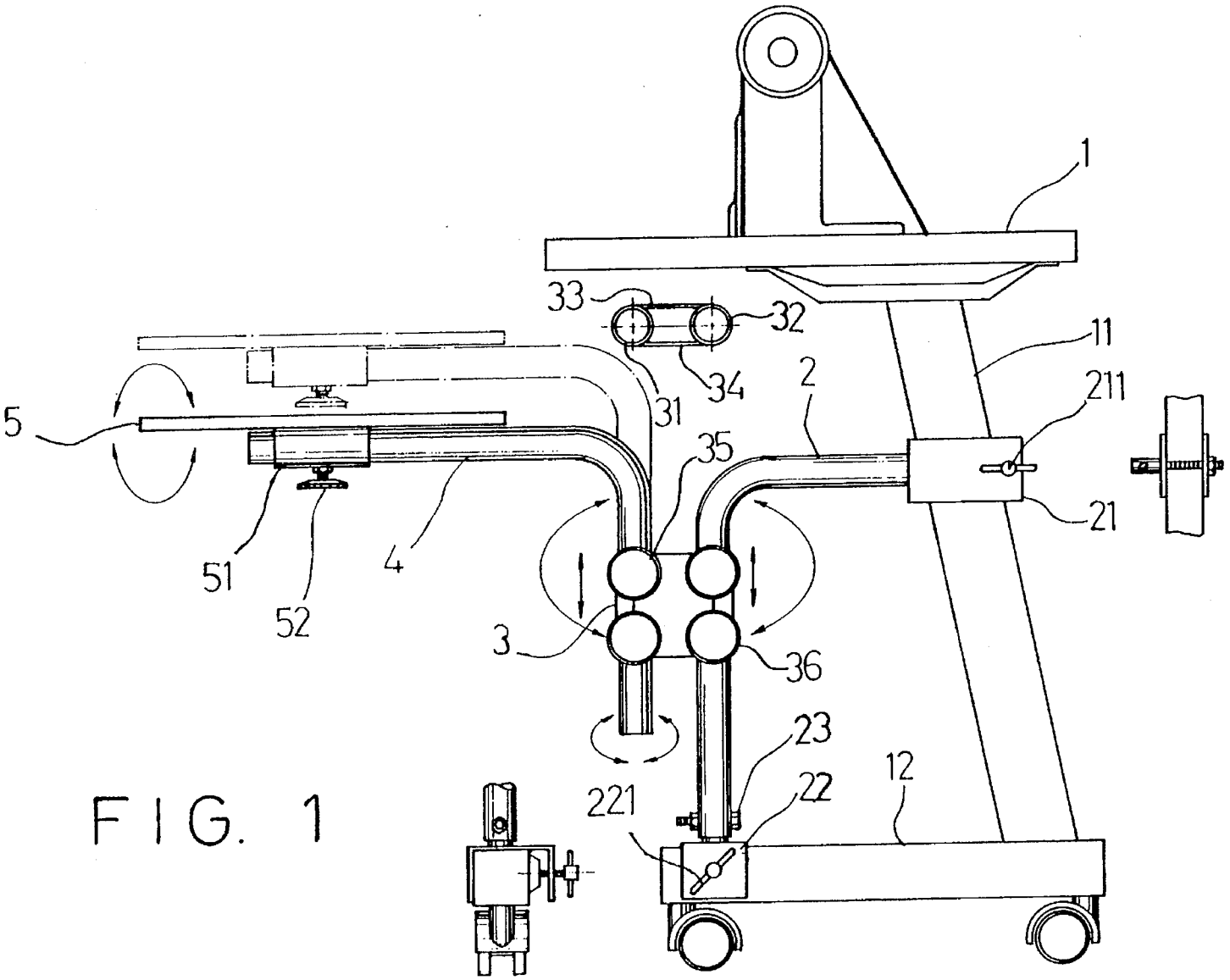
FIG. 1 is a side view of the carriage board according to the invention.

FIG. 1 shows the essential components of the invention. A stationary rod (2) combined with an extension rod (4) by a double pipe sleeve (3) is attached at one end to the support frame (11) of a sewing machine (1) via the securing means (21) with a fastening bolt (211). The other end of the stationary rod (2) is equipped with a bolt (23) and fixed to the base frame (12) of the sewing machine (1) through another securing means (22) that also has a fastening bolt (221). The double pipe sleeve (3) has two tubular portions (31) and (32) joined by the flat portions (33) and (34). On the side walls of the tubular portions (31) and (32) there are respectively arranged two fastening bolts (35) and (36) for setting in position the rods passing through the tubular portions. One tubular portion (32) of the double pipe sleeve (3) is fitted over the stationary rod (2) and the other tubular portion (33) fitted over the extension rod (4). Further, a flat board (5) is adjustably mounted on the extension rod (4) near one end of the extension rod by means of a fixing mechanism (51) and a bolt (52).

Figure 2:
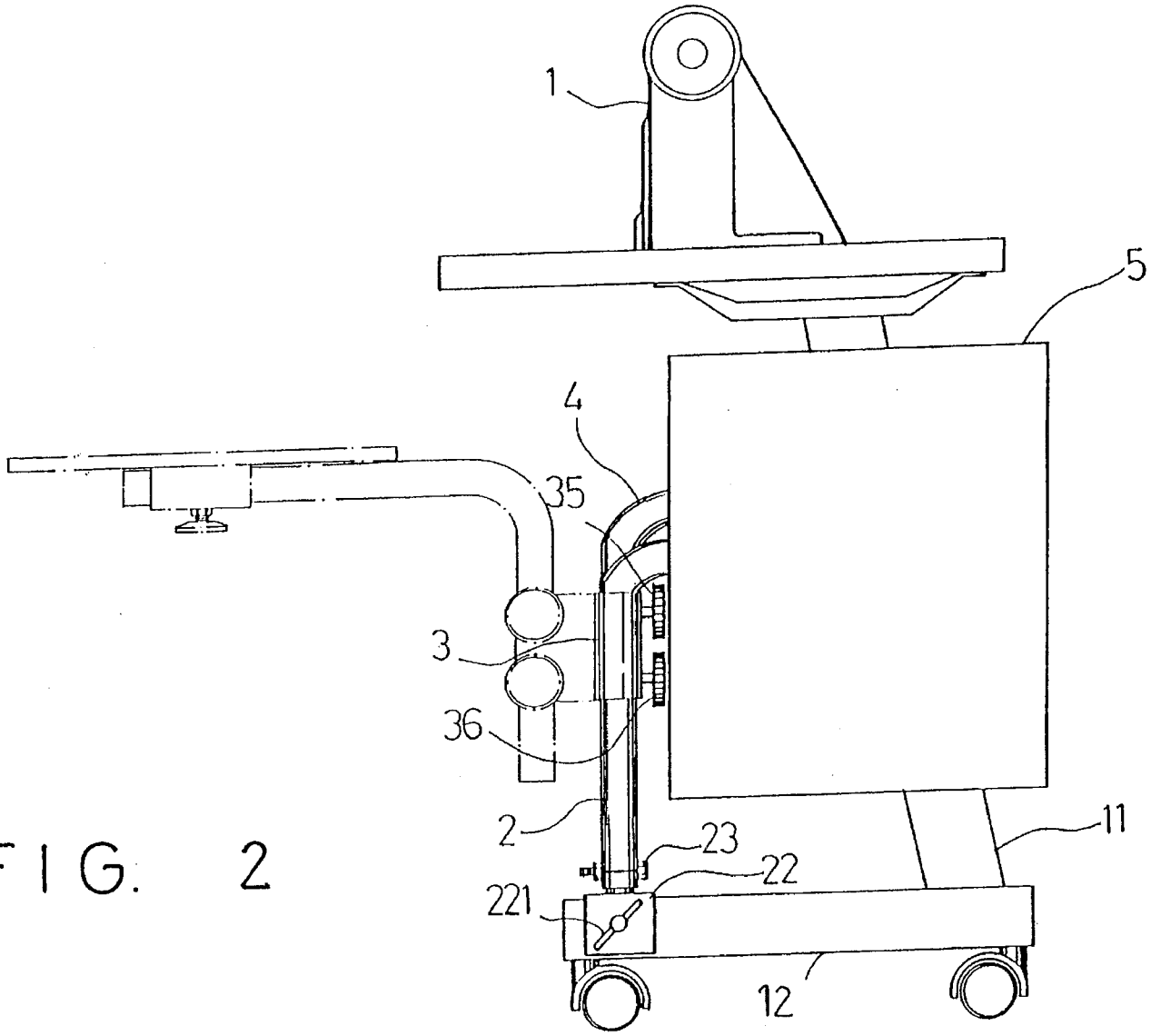
FIG. 2 is a schematic view showing the practice of the invention.

As can be seen from FIGS. 1 and 2, the carriage board of the invention can be installed on a sewing machine (1) by fixing the stationary rod (2) and the extension rod (4) respectively on the support frame and the base frame of the machine. To detach the carriage board, just loosen the fastening bolts (211) and (221) and then remove the stationary rod (2) from the securing means (21) and (22). When in use, spread the extension rod (4) to a proper position and tighten the bolts (35) on the double pipe sleeve (3). Then adjust the position of the flat board (5) by adjusting the fixing mechanism (51) and the bolt (52). If cut parts are to be laid on the board surface, the carriage board can be set in a position at which the flat surface faces upwards. However, if cut parts are to be suspended, adjust the fixing mechanism (51) to turn the board (5) ninety degrees to a vertical position. In such a position, longer cut parts can be hung on the board. Therefore the carriage board can be adapted to various garment productions without the need of containers for storing cut parts. In addition, the elevation of the flat board (5) can be altered to fit it for the body size of the operator of the sewing machine through adjusting the position of the extension rod (4) in the double pipe sleeve (3).

When moving the sewing machine from one place to another, loosen the fastening bolts (35) and (36) of the double pipe sleeve (3) and the bolt (52) of the fixing mechanism (51) and fold up the extension rod (4). In this way, the carriage board can be packed in a compact form.

As the described above, the invention uses a stationary rod, an extension rod, and a double pipe sleeve to form a support structure that enables the carriage board to be folded and adjusted in position and elevation. Obviously, the invention can achieve the foregoing objects, promoting an operator's work efficiency.

What is claimed is:

1. A carriage board for use with an industrial sewing machine, including:

a stationary rod being provided at two ends with securing means and fastening bolts by which the rod is attached to a support and a base frame of a sewing machine;

a double pipe sleeve having two tubular portions united by flat portions and two fastening bolts arranged on a side wall of the tubular portions to set in position rods extending through the tubular portions; and an extension rod having a fixing mechanism and a bolt at one end to which a flat board is mounted and extending at the other end through one of two tubular portions of said double pipe sleeve;

wherein the position and the elevation of the carriage board can be changed by loosening the fastening bolts of said double pipe sleeve to adjust said extension rod and wherein the angle of said flat board with respect to the extension rod can be adjusted by said fixing mechanism and its associated bolt.

* * * * *